US008821356B2

(12) United States Patent
Burke

(10) Patent No.: US 8,821,356 B2
(45) Date of Patent: Sep. 2, 2014

(54) FITNESS BAR

(76) Inventor: Jonathan Burke, Windermere, FL (US)

( * ) Notice: Subject to any disclaimer, the term of this patent is extended or adjusted under 35 U.S.C. 154(b) by 216 days.

(21) Appl. No.: 13/070,159

(22) Filed: Mar. 23, 2011

(65) Prior Publication Data

US 2012/0245000 A1 Sep. 27, 2012

(51) Int. Cl.
*A63B 21/06* (2006.01)
*A63B 21/075* (2006.01)
*A63B 21/072* (2006.01)

(52) U.S. Cl.
CPC ..... *A63B 21/075* (2013.01); *A63B 21/0724* (2013.01)
USPC ..... 482/93; 482/92

(58) Field of Classification Search
USPC ..... 482/92–94, 104, 106–108; D21/662, D21/679–682; 214/44, 45
See application file for complete search history.

(56) References Cited

U.S. PATENT DOCUMENTS

| | | | | | |
|---|---|---|---|---|---|
| 247,929 | A | * | 10/1881 | Folk | 251/119 |
| 257,929 | A | * | 5/1882 | Folk | 482/109 |
| 1,552,073 | A | * | 9/1925 | Mansfeldt | 482/50 |
| 1,714,391 | A | * | 5/1929 | McWhirter | 482/148 |
| 3,592,349 | A | * | 7/1971 | Baugh | 215/307 |
| 3,758,109 | A | * | 9/1973 | Bender | 482/93 |
| 4,593,903 | A | * | 6/1986 | Waitz | 482/93 |
| 4,743,016 | A | | 5/1988 | Van Derworp et al. | |
| 5,254,063 | A | | 10/1993 | House, Jr. | |
| 5,312,314 | A | * | 5/1994 | Stephan et al. | 482/110 |
| 5,316,531 | A | * | 5/1994 | Spence | 482/93 |
| 5,328,431 | A | | 7/1994 | Winslow | |
| 5,653,664 | A | | 8/1997 | Jennings | |
| 5,839,996 | A | | 11/1998 | Gooding | |
| 6,379,286 | B1 | | 4/2002 | Scopino et al. | |
| 6,599,222 | B2 | | 7/2003 | Wince | |
| 7,704,198 | B2 | * | 4/2010 | Brown, Jr. | 482/121 |
| 2006/0160675 | A1 | | 7/2006 | Brown | |

* cited by examiner

*Primary Examiner* — Stephen Crow
*Assistant Examiner* — Rae Fischer
(74) *Attorney, Agent, or Firm* — Akerman LLP

(57) ABSTRACT

A multi-piece fitness bar may include an outer, a middle, and an inner bar. The three bars may be annular and nested, one inside of the next in size. The inner bar may protrude from the ends of the middle bar, and the middle bar may protrude from the ends of the outer bar. A end-cap may be configured to hold the bars in place and in a staggered manner with respect to each other. The end-cap may include staggered internal surfaces, each designed to mate with and hold in place a specific bar. The multi-piece fitness may provide from several combinations of weight, depending upon which of the bars are used in combination or individually. Each bar may be coated with an external grip. The end-cap may provide for clearance fits between the three bars to protect the external grips and facilitate interchangeability.

9 Claims, 8 Drawing Sheets

FITNESS BAR

FIELD OF THE INVENTION

The present application relates to fitness equipment. In particular, the present applications relates to a fitness bar having multiple pieces.

BACKGROUND

Lifting weights is a way of losing body fat and increasing muscle mass. Conventional weight lifting bars are disclosed by U.S. Pat. No. 5,312,314 to Stephen et al. (entitled "Exercise Yoke"); U.S. Pat. No. 5,653,664 to Jennings (entitled "Variable Weight Exercise Stick"); U.S. Pat. No. 6,599,222 to Wince (entitled an "Encapsulated Weight System"); U.S. Pat. No. 6,379,286 to Scopino et al. (entitled "Exercise Baton With Removable Internal Weights"); and U.S. Pat. No. 5,839,996 to Gooding (entitled "Device for Performing Exercises").

However, conventional weight lifting bars may include one or more various drawbacks, such as lacking means for adding weight in a uniform manner along the entirety of the longitudinal length of the bar by way of several independently usable weight lifting bars of different length, and means for easily adding and/or removing weight to provide for different desired weight combinations. Conventional weight lifting bars may also include awkward or structurally lacking end-caps, and/or other failings.

SUMMARY

The present embodiments relate to a fitness bar, or a piece of workout equipment, that may comprise three individual weight lifting bars. The fitness bar may include an annular outer bar, an annular middle bar sized to fit within the annular outer bar, and an inner bar sized to fit within the annular middle bar. All three bars may be used independently or in any combination during a workout. The fitness bar may provide for six different combinations of weights—using all of the bars together, two of the bars together, or each bar individually. To facilitate individual use of each bar, each bar may be coated with some form of dedicated grip, such as a spray-on-rubber and/or the bar having been dipped in a material that creates grip. Additionally, the inner bar may be longer than the middle bar, and the middle bar may be longer than the outer bar, such that the ends of the three bars, when placed one inside of the next, are staggered or nested. A special end-cap may hold the staggered ends of all three bars, or any combination thereof, in place after the end-cap is screwed onto the outer bar.

In one aspect, a multi-piece fitness bar may be provided. The multi-piece fitness bar may include an outer bar. The outer bar may have an outer longitudinal length and an outer cylindrical body, with the outer cylindrical body being hollow and having an inner diameter. The multi-piece fitness bar may also include a middle bar. The middle bar may have a middle longitudinal length and a middle cylindrical body, with the middle cylindrical body being hollow and having a middle outer diameter and a middle inner diameter. The inner diameter of the outer cylindrical body may be greater than the middle outer diameter of the middle cylindrical body such that the middle bar is configured to fit inside of the outer bar. Also, the middle longitudinal length may be greater than the outer longitudinal length such that the middle bar extends from both longitudinal ends of the outer bar when the middle bar is positioned inside of the outer bar. The multi-piece fitness bar may also include an inner bar. The inner bar may have an inner longitudinal length and an inner cylindrical body, with the inner cylindrical body having an outer diameter that is less than the middle inner diameter of the middle cylindrical body such that the inner bar is configured to fit inside of the middle bar. Further, the inner longitudinal length may be greater than the middle longitudinal length such that the inner bar extends from both longitudinal ends of the middle bar when the inner bar is positioned inside of the middle bar. The multi-piece fitness bar may also include at least one end-cap configured to (a) lockingly engage the outer bar after the inner bar is positioned inside of the middle bar and the middle bar is positioned inside of the outer bar, and (b) hold the inner bar and the middle bar longitudinally in place with respect to the outer bar such that the outer bar, the middle bar, the inner bar, and the at least one end-cap form the multi-piece fitness bar.

In another aspect, a multi-piece fitness bar may be provided. The multi-piece fitness bar may include an outer annular bar having a first length, and a middle annular bar having a second length that is greater than the first length of the outer annular bar. The middle annular bar may be configured to longitudinally fit inside of the outer annular bar. The multi-piece fitness bar may include an inner bar having a third length that is greater than the second length of the middle annular bar. The inner bar may be configured to longitudinally fit inside of the middle annular bar such that when the inner bar is positioned inside of the middle annular bar, and the middle annular bar is positioned inside of the outer annular bar, the inner bar protrudes from the middle annular bar and the middle annular bar protrudes from the outer annular bar, respectively. The multi-piece fitness bar may include at least one end-piece configured to interconnect with the outer annular bar and hold the inner bar and the middle annular bar in place with respect to the outer annular bar such that the outer annular bar, the middle annular bar, the inner bar, and the at least one end-piece form the multi-piece fitness bar.

In another aspect, an end-piece for a multi-piece fitness bar may be provided. The end-piece may include a staggered interior configured to hold multiple pieces of different length longitudinally in place with respect to each other. The staggered interior may include an innermost surface configured to mate with a first longitudinal end of an inner bar. The innermost surface may be associated with a first inner diameter. The staggered interior may include a second surface configured to mate with a second longitudinal end of a middle annular bar. The second surface may be associated with a second inner diameter, the second inner diameter being greater than the first inner diameter. The end-piece may also include a set of threads for lockingly engaging an outer annular bar. The set of threads, the innermost surface, and the second surface may be longitudinally displaced from one another such that the end-piece is configured to hold the inner bar, the middle annular bar, and the outer annular bar longitudinally in place, but staggered, with respect to each other.

The above-described and other features and advantages of the present disclosure will be appreciated and understood by those skilled in the art from the following detailed description, drawings, and appended claims.

BRIEF DESCRIPTION OF THE DRAWINGS

There is shown in the drawings embodiments which are presently preferred, it being understood, however, that the invention can be embodied in other forms without departing from the spirit or essential attributes thereof.

DETAILED DESCRIPTION OF THE INVENTION

Figure 1:
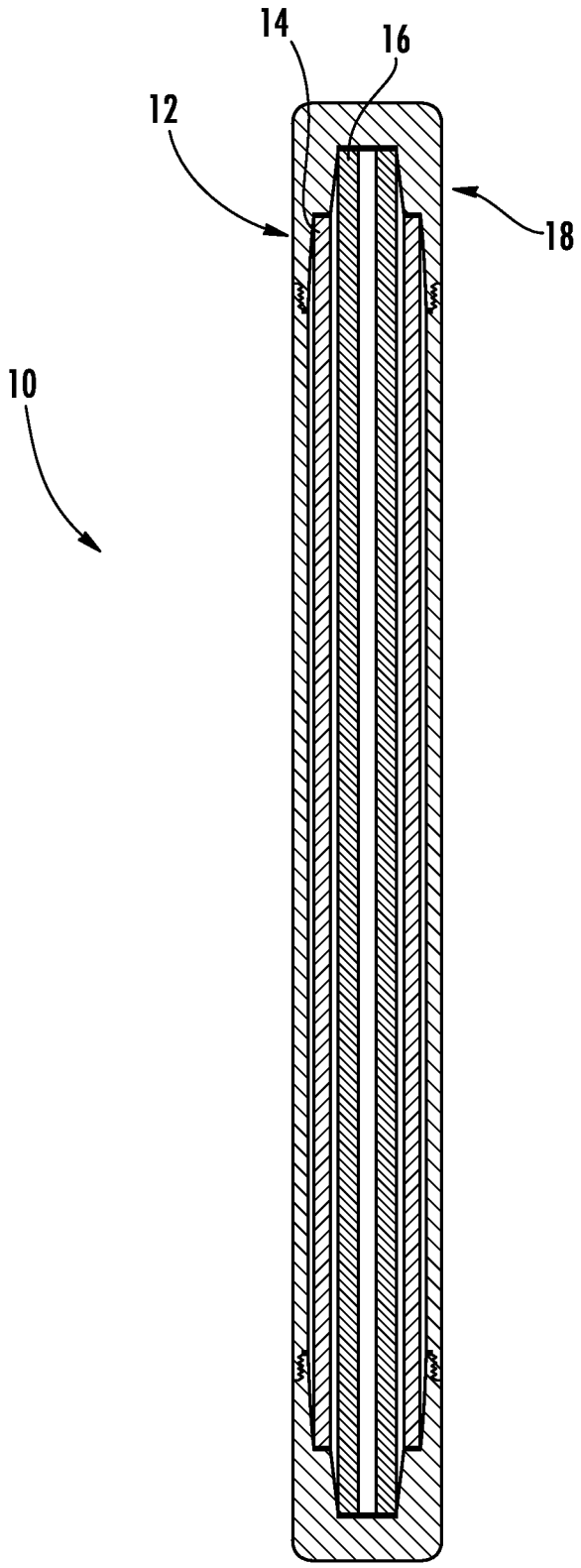
FIG. 1 depicts an exemplary multi-piece fitness bar.

The present embodiments relate to a fitness bar, or a piece of workout equipment, that may hold three weighted bars in one. All three bars may be used independently or in any combination during a workout. To facilitate individual use of each bar, each bar may be coated with some form of dedicated grip, such as a spray-on-rubber, or dipped in a material that creates grip. The fitness bar may provide for several combinations of weight using the three bars.

In one embodiment, there may be a hollow or annular outer 15 lb. bar, a hollow or annular middle 10 lb. bar configured to fit within the outer bar, and an inner 5 lb. bar configured to fit within the middle bar. As a result, the fitness bar may provide for six different combinations of weight, up to approximately 30 lbs.

In addition, there may be a secondary outermost bar made from a heavier metal. Instead of approximately 15 lbs., the secondary outer bar may weigh up to approximately 30 lbs. The middle and inner bars, may be interchangeable with the heavier outer bar to offer a workout using more weight, such as up to approximately 45 lbs. The primary and secondary outer bars, the middle bar, and the inner bar may be configured from the same or different material, and have other weights than approximately 30 lbs., 45 lbs., 10 lbs., and 5 lbs., respectively. For instance, an outer bar may weigh approximately 20 lbs., a middle bar may weigh approximately 15 lbs., and an inner bar may weigh approximately 10 lbs. Other weight amounts may be used.

In general, the overall fitness bar may be approximately 4 feet in length and have a diameter between approximately one to approximately three inches. However, the inner bar may be longer than both the middle and outer bar, and the middle bar may be longer than the outer bar. As a result, the ends of the inner, middle, and outer bar may be staggered with respect to each other.

A special end-cap may hold all three bars, or any combination thereof, in place after the end-cap is screwed onto the outer bar. The end-cap may have one or more surfaces dedicated to each individual bar. As a result, the end-cap may hold each individual bar in place with respect to the next-in-size bar in a staggered manner. Other configurations may be used.

I. Exemplary Multi-Piece Fitness Bar

In one aspect, a multi-piece fitness bar may be provided. The multi-piece fitness bar may include an outer bar. The outer bar may have an outer longitudinal length and an outer cylindrical body, with the outer cylindrical body being hollow and having an inner diameter. The multi-piece fitness bar may also include a middle bar. The middle bar may have a middle longitudinal length and a middle cylindrical body, with the middle cylindrical body being hollow and having a middle outer diameter and a middle inner diameter. The inner diameter of the outer cylindrical body may be greater than the middle outer diameter of the middle cylindrical body such that the middle bar is configured to fit inside of the outer bar. Also, the middle longitudinal length may be greater than the outer longitudinal length such that the middle bar extends from both longitudinal ends of the outer bar when the middle bar is positioned inside of the outer bar.

The multi-piece fitness bar may also include an inner bar. The inner bar may have an inner longitudinal length and an inner cylindrical body, with the inner cylindrical body having an outer diameter that is less than the middle inner diameter of the middle cylindrical body such that the inner bar is configured to fit inside of the middle bar. Further, the inner longitudinal length may be greater than the middle longitudinal length such that the inner bar extends from both longitudinal ends of the middle bar when the inner bar is positioned inside of the middle bar.

The multi-piece fitness bar may also include at least one end-cap configured to (a) lockingly engage the outer bar after the inner bar is positioned inside of the middle bar and the middle bar is positioned inside of the outer bar, and (b) hold the inner bar and the middle bar longitudinally in place with respect to the outer bar such that the outer bar, the middle bar, the inner bar, and the at least one end-cap form the multi-piece fitness bar.

The outer bar, the middle bar, and the inner bar may be interchangeable such that the multi-piece fitness bar may be configured to allow for weight differentials from approximately 5 lbs. to approximately 30 lbs. Further, the outer bar, the middle bar, and the inner bar may each be configured to be used independently for weight-lifting and have an external grip. The end-cap(s) may be configured to maintain a clearance fit between (1) the outer bar and the middle bar, and (2) the middle bar and the inner bar such that the external grips of the middle bar and the inner bar do not contact a surface on the inner diameter on the outer bar and the middle bar, respectively, once the end-cap is screwed onto the outer bar and holds the middle bar and the inner bar in place with respect to each other and the outer bar.

Each end-cap may have at least two staggered internal surfaces configured to hold the outer bar, the middle bar, and the inner bar in place with respect to each other. The at least two staggered internal surfaces may be perpendicular, or approximately perpendicular, to a longitudinal axis of the multi-piece fitness bar. Each end-cap may have a first staggered internal surface configured to mate with, or flushly engage, an end of the inner bar, and a second staggered internal surface configured to mate with, or flushly engage, an end of the middle bar. The first staggered internal surface may be displaced from the second staggered internal surface with respect to the longitudinal axis of the multi-piece fitness bar.

Each end-cap may have a first interior sloping surface, the first interior sloping surface may run between the first staggered internal surface and the second staggered internal surface and may be angled in such a manner such that first interior sloping surface extends axially outward from a center-line of a longitudinal axis of the end-cap (and/or multi-piece fitness bar) for a distance approximately equal to a clearance fit between the inner bar and the middle bar.

Each end-cap may also have a second interior sloping surface, the second interior sloping surface may run from the second staggered internal surface and toward a threaded end portion of the end-cap. The second interior sloping surface may be angled in such a manner such that the second interior sloping surface extends axially outward from a center-line of a longitudinal axis of the end-cap (and/or multi-piece fitness bar) for a distance approximately equal to a clearance fit between the middle bar and the outer bar.

FIG. 1 depicts an exemplary multi-piece fitness bar 10. The multi-piece fitness bar 10 may include an outer bar 12, a middle bar 14, an inner bar 16, and an end-cap 18 at each end of the multi-piece fitness bar 10. The multi-piece fitness bar 10 may include additional, fewer, or alternate components.

The outer bar 12 may be configured to have a cylindrical exterior, and a hollow, cylindrical interior. As a result, the outer bar 12 may have an annular body with an outer diameter and an inner diameter. The inner diameter of the outer bar 12 may be large enough such that the middle bar 14 and the inner bar 16 are sized to fit inside of the outer bar 12. The annular body of the outer bar 12 may have various thicknesses.

The outer bar 12 may have threads at each longitudinal end. The threads may be configured for locking engagement with an end-cap 18, such that the end-cap 18 holds the middle bar 14 and the inner bar 16 in place longitudinally with respect to each other and the outer bar 12.

The outer bar 12 may have a longitudinal length of between approximately one and approximately five feet. In one embodiment, the outer bar 12 may have a longitudinal length of approximately 44.0 inches, and may be shorter than the middle bar 14 and the inner bar 16. Other lengths may be used.

Similar to the outer bar 12, the middle bar 14 may be configured to have a cylindrical exterior, and a hollow, cylindrical interior. As a result, the middle bar 14 may have an annular body with an outer diameter and an inner diameter. The outer diameter of the middle bar 14 may be small enough such that the middle bar 14 may be sized to fit inside of the outer bar 12. The inner diameter of the middle bar 14 may be large enough such that the inner bar 16 may be sized to fit inside of the middle bar 14. The annular body of the middle bar 14 may have various thicknesses.

The middle bar 14 may have a flat or other surface at each longitudinal end. The flat surface may be approximately perpendicular to the longitudinal axis of the fitness bar 10 and may be configured to mate with a corresponding flat, and approximately perpendicular surface or stop on the end-cap 18. The end-cap may hold the middle bar 14 in place longitudinally with respect to the outer bar 12 and the inner bar 16.

The middle bar 14 may have a longitudinal length of between approximately one and approximately five feet. In one embodiment, the middle bar 14 may have a longitudinal length of approximately 45.6 inches, and may be longer than the outer bar 12, but shorter than the inner bar 16. Other lengths may be used.

The inner bar 16 may be configured to have a cylindrical exterior. The inner bar 16 may be a solid bar, or alternatively, may have a hollow, cylindrical interior. As a result, the inner bar 16 may have an annular body with an outer diameter and an inner diameter. The outer diameter of the inner bar 16 may be small enough such that the inner bar 16 may be sized to fit inside of the middle bar 14. The annular body of the inner bar 16 may have various thicknesses.

The inner bar 16 may have a flat or other surface at each longitudinal end. The flat surface may be approximately perpendicular to the longitudinal axis of the fitness bar 10 and may be configured to mate with a corresponding flat, and approximately perpendicular surface or stop on the end-cap 18. The end-cap may hold the inner bar 14 in place longitudinally with respect to the outer bar 12 and the middle bar 14.

The inner bar 16 may have a longitudinal length of between approximately one and approximately five feet. In one embodiment, the inner bar 16 may have a longitudinal length of approximately 47.0 inches, and may be longer than the outer bar 12 and the middle bar 14. Other lengths may be used.

Figure 2:
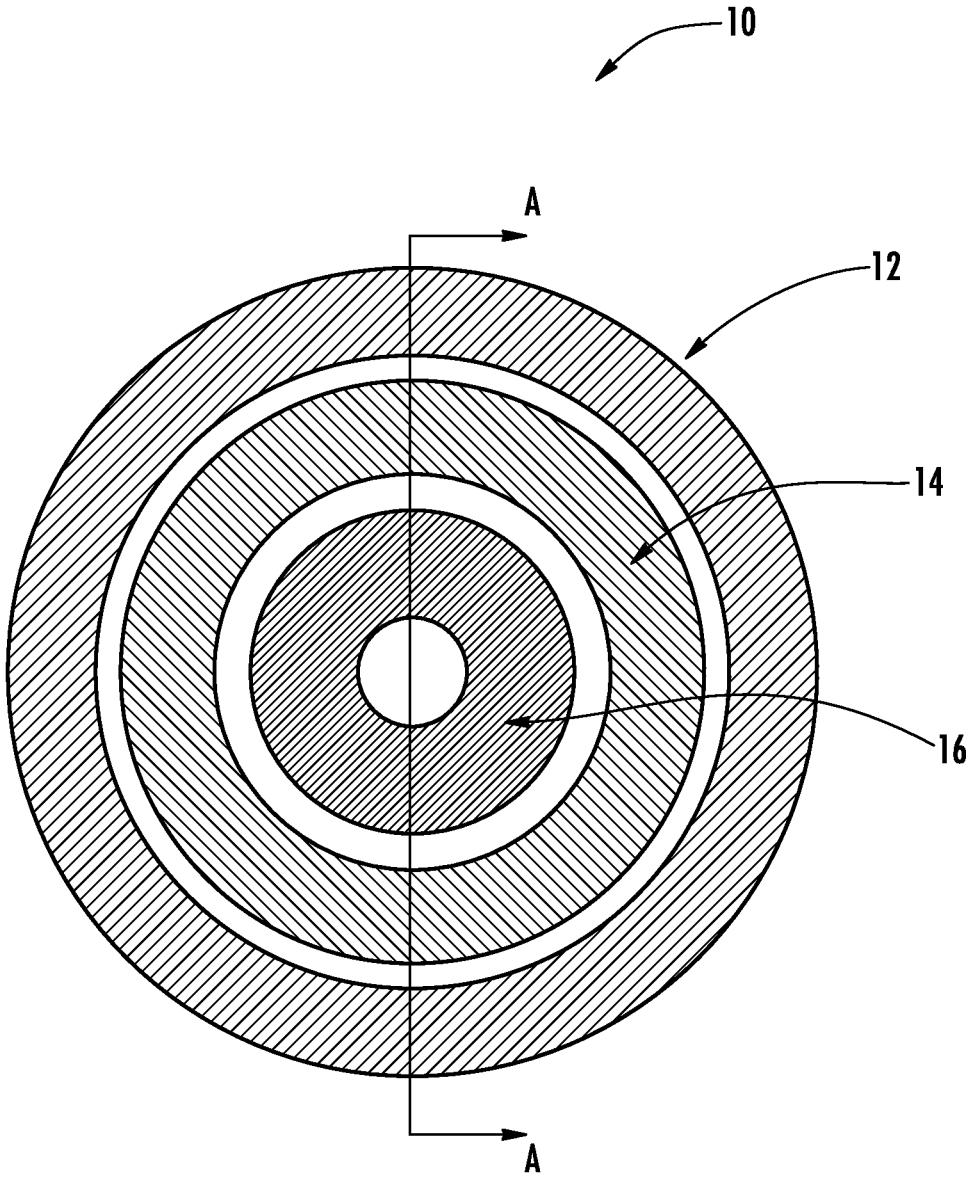
FIG. 2 depicts an internal cross-sectional view of the exemplary multi-piece fitness bar.

FIG. 2 shows an exemplary cross-sectional view of the multi-piece fitness bar 10. As shown, the outer bar 12, the middle bar 14, and the inner bar 16 may each have an annular cross-section. The outer bar 12 may have an inner diameter that is larger than the outer diameter of the middle bar 14. There may be a gap or clearance fit between the inner diameter of the outer bar 12 and the outer diameter of the middle bar 14. The clearance fit may facilitate and ease the interchangeability of the middle bar 14 with respect to the outer bar 12 during use, as well as prolong the life of the grip on the exterior of the middle bar 14. In one embodiment, the clearance fit between the outer bar 12 and the middle bar 14 may be approximately 0.06 inches. Other dimensions may be used.

The middle bar 14 may have an inner diameter that is larger than the outer diameter of the inner bar 16. There may be a gap or clearance fit between the inner diameter of the middle bar 14 and the outer diameter of the inner bar 16. The clearance fit may facilitate and ease the interchangeability of the inner bar 16 with respect to both the middle bar 14 and the outer bar 12 during use, as well as prolong the life of the grip on the exterior of the inner bar 16. The clearance fit between the inner bar 16 and the middle bar 14 may be larger than the clearance fit between the middle bar 14 and the outer bar 16. In one embodiment, the clearance fit between the inner bar 16 and the middle bar 14 may be approximately 0.09 inches. Other dimensions may be used.

Figure 3:
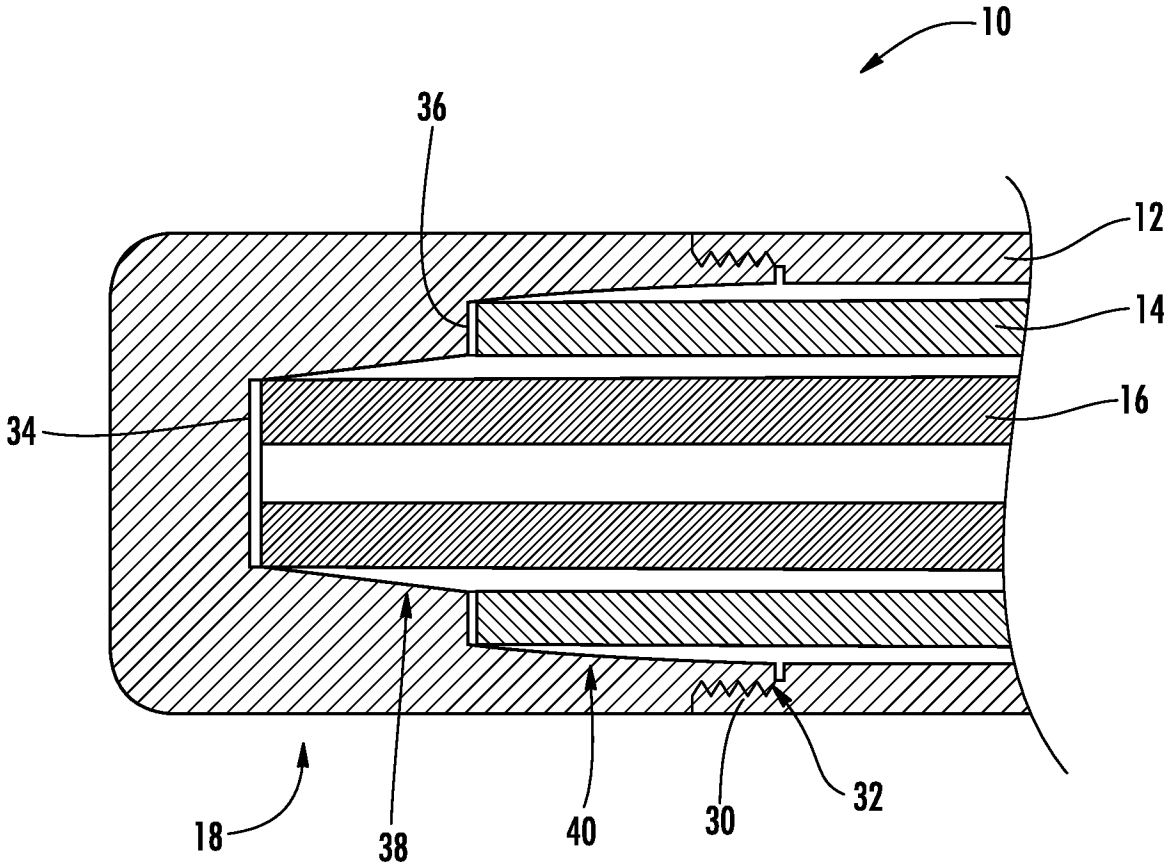
FIG. 3 depicts a longitudinal internal or cross-sectional view of the exemplary multi-piece fitness bar.

FIG. 3 depicts an exemplary longitudinal cross-sectional view of an end portion of the multi-piece fitness bar 10. The multi-piece fitness bar 10 may house the inner bar 16 nested inside of the middle bar 14, and the middle bar 14 nested inside of the outer bar 16. The end-cap 18 may include a thread set 30 for interlocking with an thread set 32 located at the end of the outer bar 12.

In one embodiment, the inner bar 16 may have an annular width of approximately 0.25 inches, and an outer diameter of approximately 0.75 inches. The middle bar 14 may have an annular width of approximately 0.22 inches, and an outer diameter of approximately 1.38 inches. The outer bar 12 may have an annular width of approximately 0.2 inches, and an outer diameter of approximately 1.9 inches. Other dimensions may be used.

The end-cap 18 may have an interior flat or horizontal surface 34, and an outer flat or horizontal surface 36. The interior flat surface 34 may have a length of approximately 1.38 inches. The interior flat surface 34 may be perpendicular, or approximately perpendicular, to the longitudinal axis of the multi-piece fitness bar. The end of the inner bar 16 may mate smoothly with, or flushly engage, the interior flat surface 34 when the end-cap 18 is screwed onto the outer bar 12 during use.

The outer flat surface 36 may have a length of approximately 0.22 inches or approximately the width of the middle bar 14. The outer flat surface 36 may be perpendicular, or approximately perpendicular, to the longitudinal axis of the multi-piece fitness bar. The end of the middle bar 14 may mate smoothly with, or flushly engage, the outer flat surface 36 when the end-cap 18 is screwed onto the outer bar 12 during use.

The end-cap 18 may have an interior sloped surface 38 that may run from the interior flat surface 34 to the outer flat surface 36. The interior sloped surface 38 may have a longitudinal length of approximately 0.75 inches along the longitudinal axis of the multi-piece fitness bar. The interior sloped surface 38 may have an incline and cover, or approximately cover, the entire length of the clearance fit between the inner bar 16 and the middle bar 14 moving axially outward from the inner bar 16 toward the middle bar 14.

The end-cap 18 may have an outer sloped surface 40 that may run from the outer flat surface 36 to a threaded portion of the end-cap 18 having a thread set 30. The outer sloped surface 40 may have a longitudinal length of approximately 0.78 inches along the longitudinal axis of the multi-piece fitness bar. The outer sloped surface 40 may have an incline and cover, or approximately cover, the entire length of the clearance fit between the middle bar 14 and the outer bar 16 moving axially outward from the middle bar 14 toward the outer bar 12.

The inner bar 16 may be longer than the middle bar 14, and the middle bar 14 may be longer than the outer bar 12. As a result, the end of the inner bar 16 may extend past the end of the middle bar 14, and the end of the middle bar 14 may extend past the end of the outer bar 12. The end-cap 18 may be configured to snuggly engage the staggered ends of the inner bar 16, the middle bar 14, and the outer bar 12. For instance, the inner flat surface 34 of the end-cap 18 may mate with the end of the inner bar 12, the outer flat surface 36 may mate with the middle bar 14, and the thread set 30 of the end-cap 18 may screw into the thread set 32 on the end of the outer bar 12.

The staggering of the ends of the outer bar 12, the middle bar 14, and the inner bar 16 may facilitate adjusting the weight of the multi-piece fitness bar and interchanging (such as removing and/or adding) one or more of the bars 12, 14, 16 from the overall multi-piece fitness bar. For instance, after a user removes the end-cap 18 during use, the end of the inner bar 16 may protrude from the end of the middle bar 14 and/or the outer bar 12. As a result, a user may grip the end of the inner bar 16 that protrudes from the end of the middle bar 14 and/or outer bar 12 and remove the inner bar 16 from the middle bar 14 and/or outer bar 12 using the protruding end of the inner bar 16.

Likewise, the end of the middle bar 14 may protrude from the end of the outer bar 12. As a result, a user may grip the end of the middle bar 14 that protrudes from the end of the outer bar 12 and remove the middle bar 14 from the outer bar 12 using the protruding end of the middle bar 14.

II. Exemplary End-Cap

In one aspect, an end-piece or end-cap for a multi-piece fitness bar may be provided. The end-cap may include a staggered interior configured to hold multiple pieces/bars of different length longitudinally in place with respect to each other. The staggered interior may include an innermost surface configured to mate with a first longitudinal end of an inner bar. The innermost surface may be associated with a first inner diameter. The staggered interior may include a second surface configured to mate with a second longitudinal end of a middle annular bar. The second surface may be associated with a second inner diameter, the second inner diameter being greater than the first inner diameter. The end-cap may also include a set of threads for lockingly engaging an outer annular bar. The set of threads, the innermost surface, and the second surface may be longitudinally displaced from one another such that the end-cap is configured to hold the inner bar, the middle annular bar, and the outer annular bar longitudinally in place, but staggered, with respect to each other.

The staggered interior of the end-cap may be configured to provide for clearance fits between the inner bar and the middle annular bar, and the middle annular bar and the outer annular bar, respectively. The end-cap may comprise a first interior sloping surface running from the innermost surface to the second surface. The first interior sloping surface may extend axially outward from a center-line of a longitudinal axis of the end-cap (and/or fitness bar) to provide for a clearance fit between the inner bar and the middle annular bar the length of the fitness bar. The end-cap may also comprise a second interior sloping surface running from the second surface to an end portion associated with the set of threads. The second interior sloping surface may extend axially outward from a center-line of a longitudinal axis of the end-cap (and/or fitness bar) to provide for a second clearance fit between the middle annular bar and the outer annular bar that extends the length of the fitness bar.

Figure 4:
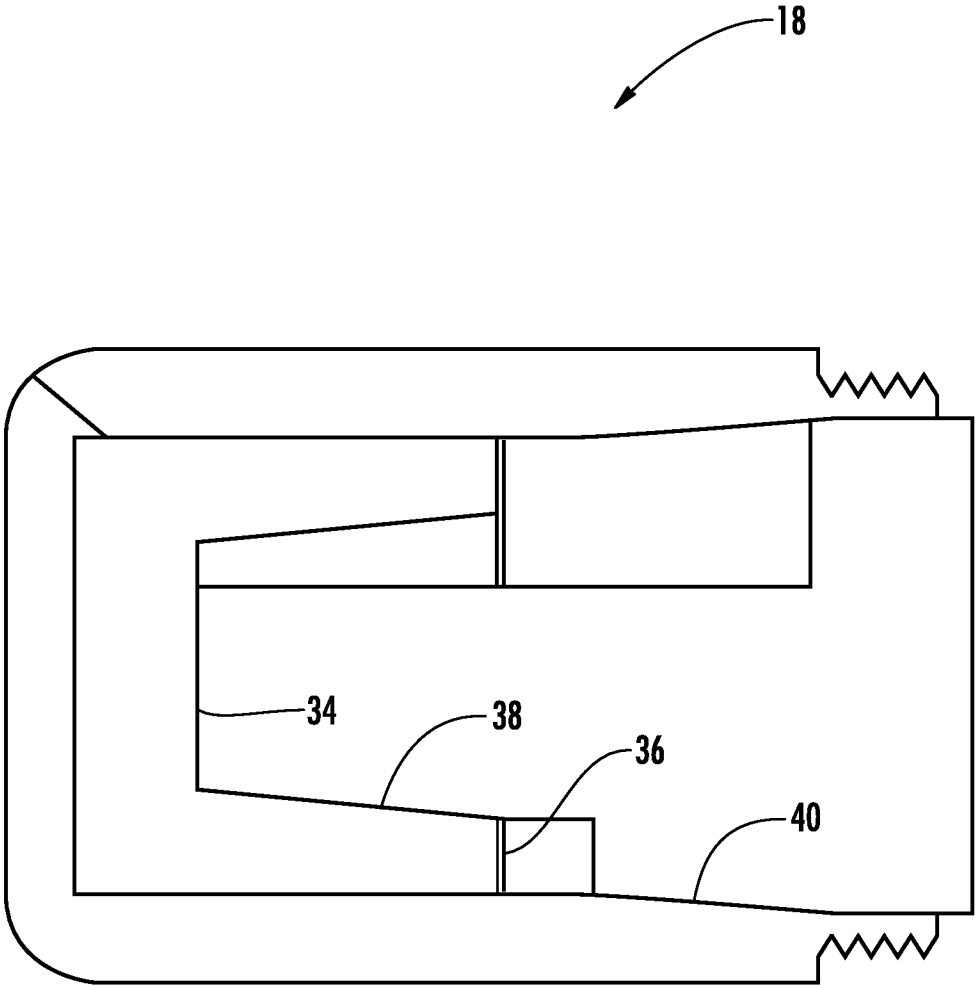
FIG. 4 depicts a longitudinal internal or cross-sectional view of an exemplary end-piece associated with the exemplary multi-piece fitness bar.

FIG. 4 depicts a longitudinal cross-sectional view of an exemplary end-cap 18. The end-cap 18 may have an inner flat surface 34 perpendicular or approximately perpendicular to the longitudinal axis of the multi-piece fitness bar. In one embodiment, the inner flat surface 34 may have a length of approximately 0.75 inches, which may be approximately the same length as the outer diameter of the inner bar. The end-cap 18 may have an interior sloping surface 38 that may run into the inner flat surface 34. The interior sloping surface 38 may be sloped and facilitate holding the inner bar in place axially with respect to the middle bar and the outer bar.

The end-cap 18 may have an outer flat surface 36 perpendicular or approximately perpendicular to the longitudinal axis of the multi-piece fitness bar. In one embodiment, the outer flat surface 36 may have a length of approximately 0.22 inches, which may be approximately the same length as the width of the annular body of the middle bar. The end-cap 18 may have an outer sloping surface 40 that may run into the outer flat surface 36. The outer sloping surface 40 may be sloped and facilitate holding the middle bar in place axially with respect to the outer bar. The interior sloping surface 38 may also run into the outer flat surface 36.

The end-cap 18 may have a longitudinal length of approximately 2.2 inches that comprises (a) a thread set having a longitudinal length of approximately 0.2 inches, and (b) a remaining body portion having a longitudinal length of approximately 2.0 inches. The end-cap 18 may have an outer diameter of approximately 1.9 inches. Other dimensions may be used for the end-cap 18 components.

Figure 5:
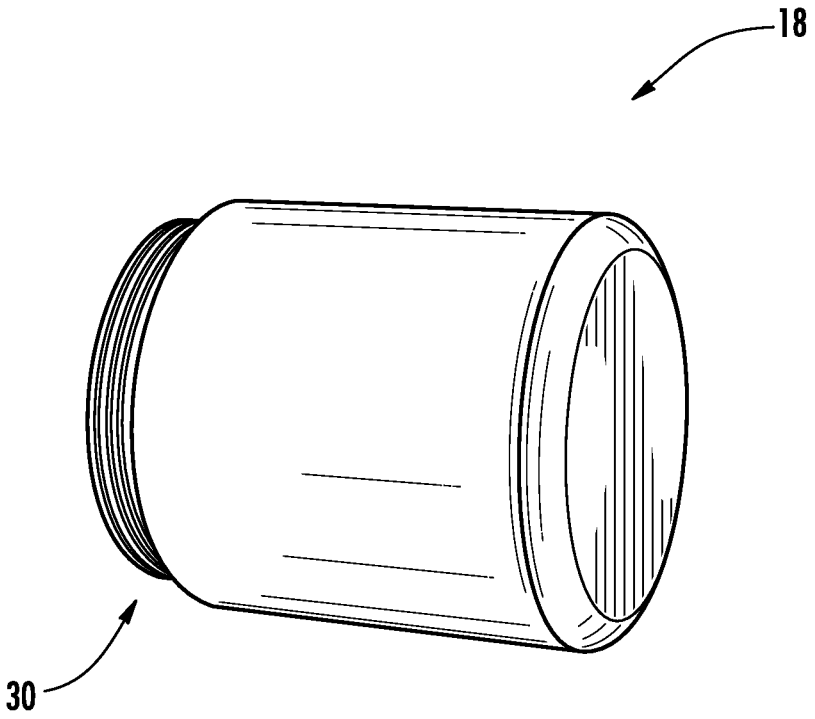
FIG. 5 depicts an exterior of an exemplary end-piece for use with the exemplary multi-piece fitness bar.
Figure 6:
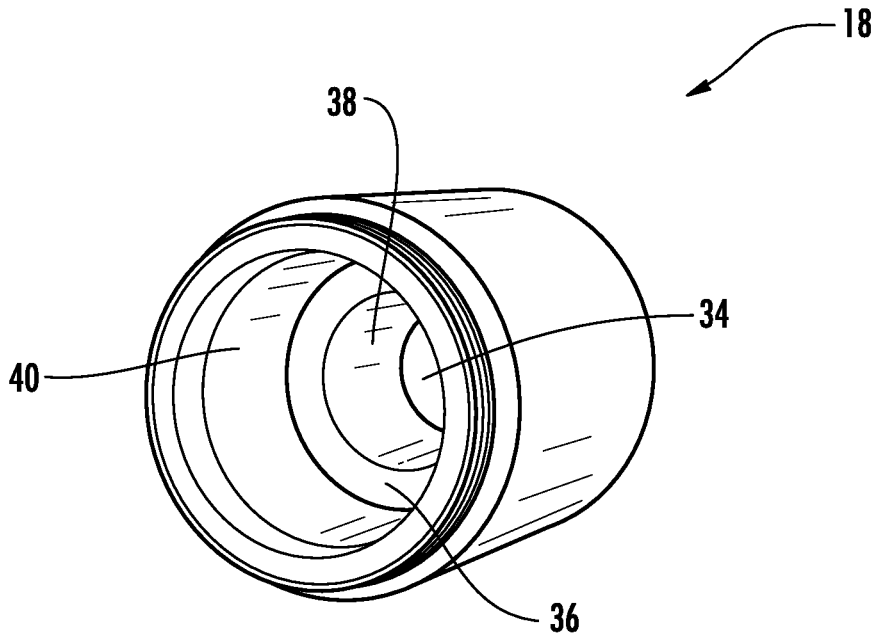
FIG. 6 depicts an interior of an exemplary end-piece for use with the exemplary multi-piece fitness bar.

FIG. 5 depicts an exterior view of an exemplary end-piece 18. The end-piece may include a smooth exterior and a thread set 30. FIG. 6 depicts a perspective view of the interior of the exemplary end-piece 18. The end-piece 18 may include an inner flat surface 34 and an outer flat surface 36. The inner flat surface 34 and the outer flat surface 36 may be displaced with respect to each other along a longitudinal axis of the end-piece 18. The end-piece 18 may also include an interior sloping surface 38 and an outer sloping surface 40.

Figure 7:
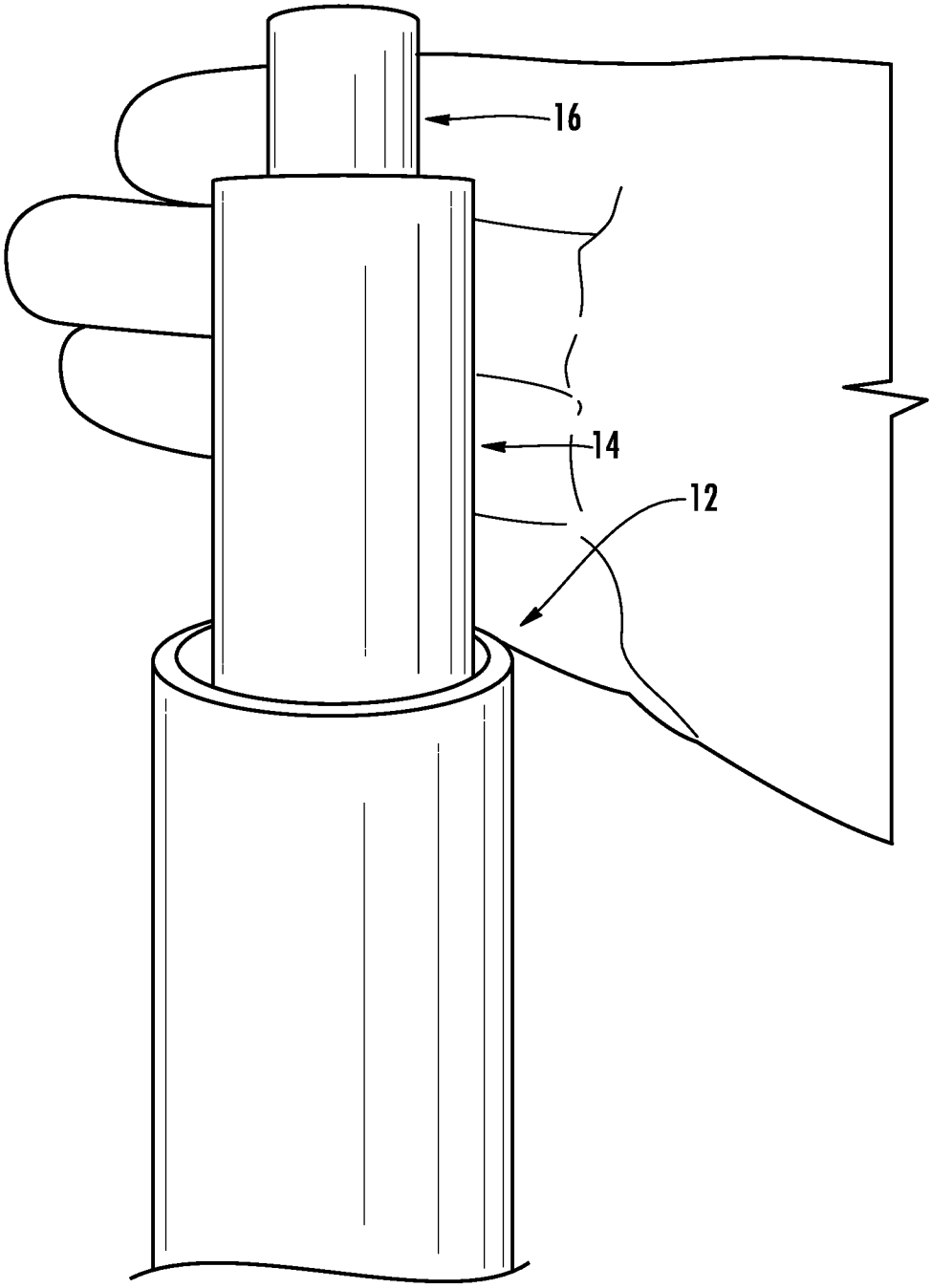
FIG. 7 depicts a nested arrangement of an outer bar, a middle bar, and an inner bar associated with the exemplary multi-piece fitness bar.

FIG. 7 depicts a view of exemplary nested weight lifting bars. As shown, the inner bar 16 may fit within the middle bar 14, and the middle bar 14 may fit within the outer bar 12. The end of the inner bar 16 may protrude from the middle bar 14, and the end of the middle bar 14 may protrude from the outer bar 12. Other configurations may be used.

III. Exemplary Method of Use

Figure 8:
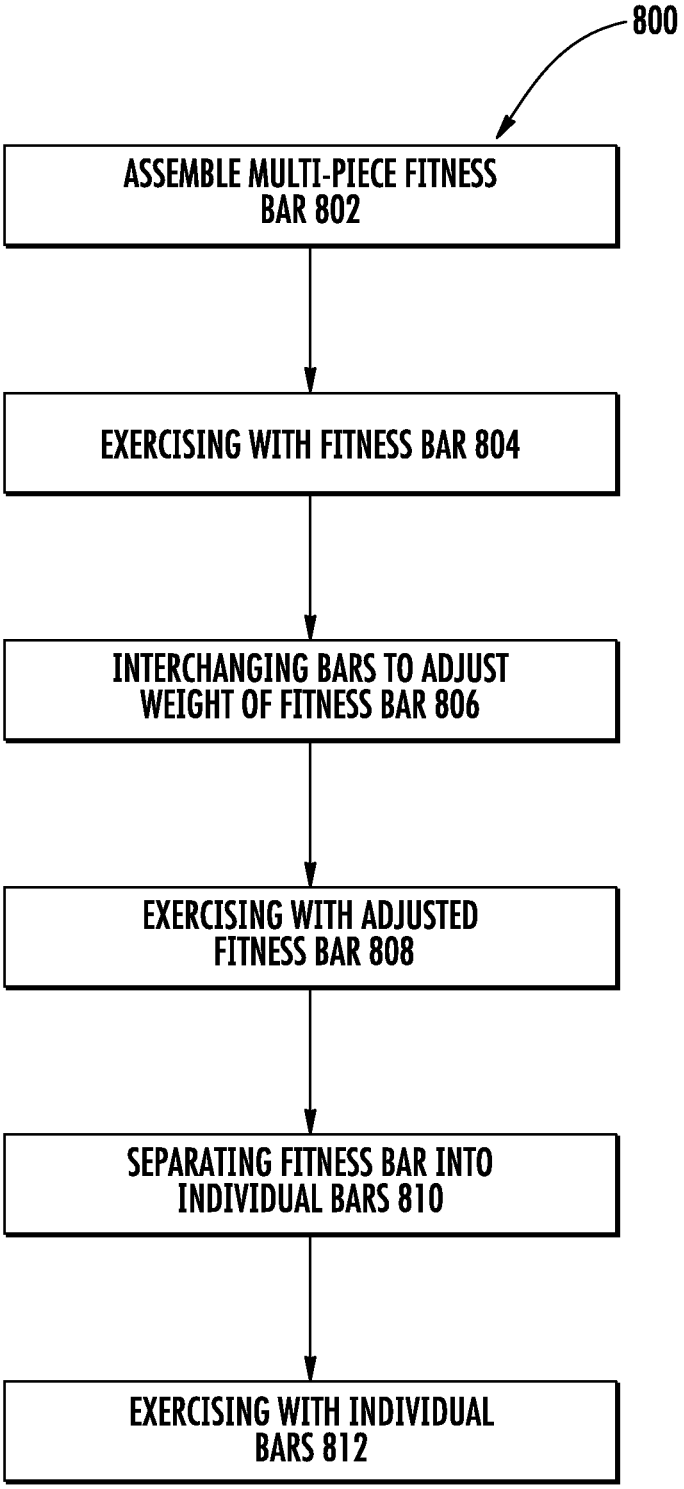
FIG. 8 depicts an exemplary method of using a multi-piece fitness bar.

FIG. 8 depicts an exemplary method of using the multi-piece fitness bar 800. The method 800 may include assembling the multi-piece fitness bar 802, exercising with the fully assembled multi-piece fitness bar 804, interchanging one or more of the smaller bars to adjust the weight of the multi-piece fitness bar 806, exercising with the adjusted multi-piece fitness bar 808, separating the multi-piece fitness bar into the smaller individual bars 810, and exercising using the individual bars 812. The method may include additional, fewer, or alternate steps.

The method 800 may include assembling the multi-piece fitness bar 802. The multi-piece fitness bar may be assembled to include an inner bar nested within a middle bar, and the middle bar nested within an outer bar. The ends of the inner bar, the middle bar, and the outer bar may be staggered. An end-piece may cover the staggered ends of the bars and hold the bars in place with respect to each other after the end-piece is screwed onto an end of the outer bar.

The method 800 may include exercising with the fully assembled multi-piece fitness bar 804. The fully assembled multi-piece fitness bar may weigh more than a partially assembled fitness bar or the individual bars. Therefore, a user may wish to start their workout with the fully assembled multi-piece fitness bar. Alternatively, the user may wish to work up to the weight of the fully assembled multi-piece fitness bar. The fully assembled multi-piece fitness bar may include various total weights. In one embodiment, a 15 lb. outer bar, a 10 lb. middle bar, and a 5 lb. inner bar may be used. A secondary outer bar of 30 lb. may also be provided. Bars of greater or lesser weights may be used.

The method 800 may include interchanging one or more of the bars to adjust the weight of the multi-piece fitness bar 806. The interchanging may involve removing and/or adding one or more individual bars from the multi-piece fitness bar 806. For instance, after a user has exercised with the fully assembled fitness bar, which may weigh 30 lbs. in one embodiment, the user may wish to go down in weight. The user may remove the end-cap and remove the 5 lb. inner bar, and then replace the end-cap onto the outer bar.

The method 800 may include exercising with the adjusted multi-piece fitness bar 808. For instance, after a user removes the 5 lb. inner bar, the user may then continue his or her workout using the 25 lb. multi-piece fitness bar that includes the 15 lb. outer bar and the 10 lb. middle bar.

After which, the user may wish to go down in weight again. The user may remove the end-cap, remove the 10 lb. middle bar, re-insert the 5 lb. inner bar into the 15 lb. outer bar, and then replace the end-cap. The user may then continue his or her workout using the 20 lb. multi-piece fitness bar that includes the 15 lb. outer bar and the 5 lb. inner bar. A user may reverse the foregoing, and add or go up in weight during a workout.

The method 800 may include separating the multi-piece fitness bar into individual bars 810. After exercising with the fitness bar configured to have multiple bars, the user may wish to go further down in weight, and to use the outer bar, the middle bar, and/or the inner bar individually. The user may remove the end-cap and separate the outer bar, the middle bar, and the inner bar.

The method 800 may include exercising using the individual bars 812. For example, after the user has separated the individual bars, as discussed directly above, the user may exercise using the 15 lb. outer bar, the 10 lb. middle bar, and/or the 5 lb. inner bar individually.

Instead of going down in weight during a workout, a user may wish to go up in weight instead. For instance, a user may wish to start with the lower weights as a means of stretching out and avoiding muscle pulls. Alternatively, the user may wish a varied workout that includes various increases and decreases of the weight being used. For instance, a user may wish to start with 5 lbs., move up to 30 lbs., move down to 10 lbs., and then move back up to 20 lbs. Other weight variations and schedules may be used.

The present invention may be embodied in other forms without departing from the spirit or essential attributes thereof and, accordingly, reference should be had to the following claims rather than the foregoing specification as indicating the scope of the invention. Further, the illustrations of arrangements described herein are intended to provide a general understanding of the structure of various embodiments, and they are not intended to serve as a complete description of all the elements and features of apparatus and systems that might make use of the structures described herein. Many other arrangements will be apparent to those of skill in the art upon reviewing the above description. Other arrangements may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Thus, although specific arrangements have been illustrated and described herein, it should be appreciated that any arrangement calculated to achieve the same purpose may be substituted for the specific arrangement shown. This disclosure is intended to cover any and all adaptations or variations of various embodiments and arrangements of the invention. Combinations of the above arrangements, and other arrangements not specifically described herein, will be apparent to those of skill in the art upon reviewing the above description. Therefore, it is intended that the disclosure not be limited to the particular arrangement(s) disclosed as the best mode contemplated for carrying out this invention, but that the invention will include all embodiments and arrangements falling within the scope of the appended claims.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims.

What is claimed is:

1. A multi-piece fitness bar, the multi-piece fitness bar comprising:

an outer bar, the outer bar having a cylindrical body and an outer longitudinal length extending between a first outer end and a second outer end, the outer cylindrical body being hollow and having an inner diameter;

a middle bar, the middle bar having a middle cylindrical body and a middle longitudinal length extending between a first outer end and a second outer end, the middle cylindrical body being hollow and having a middle outer diameter and a middle inner diameter, the inner diameter of the outer cylindrical body being greater than the middle outer diameter of the middle cylindrical body such that the middle bar is configured to fit inside of the outer bar, the middle longitudinal length being greater than the outer longitudinal length;

an inner bar, the inner bar having an inner cylindrical body and an inner longitudinal length extending between a first inner end and a second inner end, the inner cylindrical body having an outer diameter that is less than the middle inner diameter of the middle cylindrical body such that the inner bar is configured to fit inside of the middle bar, the inner longitudinal length being greater than the middle longitudinal length; and at least one end-cap configured to (a) lockingly engage at least one of the first outer end or the second outer end of the outer bar such that the end-cap can be engaged and thereby retained on the outer bar without positioning either one or both of the inner and middle bars inside the outer bar or after the inner bar is positioned inside of the middle bar and the middle bar is positioned inside of the outer bar, and (b) hold the inner bar and the middle bar longitudinally in place with respect to the outer bar such that the outer bar, the middle bar, the inner bar, and the at least one end-cap form the multi-piece fitness bar;

wherein, when the inner bar and the middle bar are longitudinally in place with respect to the outer bar and the at least one end-cap is lockingly engaged to the outer bar to form the multi-piece fitness bar, the first middle end and the second middle end of the middle bar extend from the corresponding first outer end and second outer end of the outer bar and the first inner end and the second inner end of the inner bar extend from the corresponding first middle end and the second middle end of the middle bar.

2. The multi-piece fitness bar of claim 1, wherein the outer bar, the middle bar, and the inner bar are interchangeable such that the multi-piece fitness bar is configured to allow for weight differentials from approximately 5 lbs. to approximately 30 lbs.

3. The multi-piece fitness bar of claim 1, wherein the outer bar, the middle bar, and the inner bar are each configured to be used independently for weight-lifting and each have an external gripping surface thereon.

4. The multi-piece fitness bar of claim 3, wherein the at least one end-cap comprises a threaded portion configured to lockingly engage corresponding threads positioned at at least one of the first outer end and second outer end of the outer bar, and wherein the at least one end-cap is configured to maintain a clearance fit between (1) the outer bar and the middle bar, and (2) the middle bar and the inner bar such that the external grip of the middle bar does not contact the inner diameter on the outer bar and the external grip of the inner bar does not contact the middle inner diameter of the middle bar, respectively, once the at least one end-cap is screwed onto the outer bar and holds the middle bar and the inner bar in place with respect to each other and the outer bar.

5. The multi-piece fitness bar of claim 1, wherein the at least one end-cap has at least two staggered internal surfaces configured to hold the outer bar, the middle bar, and the inner bar in place with respect to each other, the at least two staggered internal surfaces are approximately perpendicular to a longitudinal axis of the multi-piece fitness bar.

6. The multi-piece fitness bar of claim 1, wherein the at least one end-cap has a first staggered internal surface configured to mate with the first inner end or second inner end of the inner bar, and a second staggered internal surface configured to mate with the first middle end or the second middle end of the middle bar, the first staggered internal surface being displaced from the second staggered internal surface with respect to a longitudinal axis of the multi-piece fitness bar.

7. The multi-piece fitness bar of claim 6, wherein the at least one end-cap has a first interior sloping surface, the first interior sloping surface running between the first staggered internal surface and the second staggered internal surface and angled in such a manner such that first interior sloping surface extends axially outward from a center-line of a longitudinal axis of the at least one end-cap for a distance approximately equal to the clearance fit between the inner bar and the middle bar.

8. The multi-piece fitness bar of claim 7, wherein the at least one end-cap has a second interior sloping surface, the second interior sloping surface running from the second staggered internal surface and toward a threaded end portion of the at least one end-cap, the second interior sloping surface being angled in such a manner such that second interior sloping surface extends axially outward from the center-line of the longitudinal axis of the at least one end-cap for a distance approximately equal to the clearance fit between the middle bar and the outer bar.

9. The multi-piece fitness bar of claim 1, wherein the at least one end-cap comprises a first end-cap configured to locking engage the first outer end of the outer bar and a second end-cap configured to lockingly engage the second outer end of the outer bar, and wherein when the inner bar and the middle bar are longitudinally in place with respect to the outer bar such that the outer bar, the middle bar, the inner bar, and the at first and second end-caps form the multi-piece fitness bar, the first end-cap may be removed from locking engagement with the first outer end such that a respective external surface of both the first middle end and the first inner end that protruding from the first outer end may be griped by a user without changing the longitudinal positions of the inner, middle, and outer bars to allow the user to selectively remove either or both of the inner bar and middle bar before relockingly engaging the first end-cap to the first outer end.

* * * * *